US009142221B2

(12) United States Patent
Sun et al.

(10) Patent No.: US 9,142,221 B2
(45) Date of Patent: Sep. 22, 2015

(54) NOISE REDUCTION

(75) Inventors: Xuejing Sun, Rochester Hills, MI (US); Kuan-Chieh Yen, Northville, MI (US); Rogerio Guedes Alves, Macomb, MI (US)

(73) Assignee: Cambridge Silicon Radio Limited, Cambridge (GB)

( * ) Notice: Subject to any disclaimer, the term of this patent is extended or adjusted under 35 U.S.C. 154(b) by 1677 days.

(21) Appl. No.: 12/098,570

(22) Filed: Apr. 7, 2008

(65) Prior Publication Data

US 2009/0254340 A1 Oct. 8, 2009

(51) Int. Cl.

| | |
|---|---|
| ***G10L 21/00*** | (2013.01) |
| ***G10L 21/0216*** | (2013.01) |
| ***G10L 21/0208*** | (2013.01) |
| *G10L 25/78* | (2013.01) |
| *G10L 25/90* | (2013.01) |

(52) U.S. Cl.

CPC ..... *G10L 21/0208* (2013.01); *G10L 25/78* (2013.01); *G10L 25/90* (2013.01); *G10L 2021/02163* (2013.01)

(58) Field of Classification Search

CPC ..... G10L 25/84; G10L 17/20; G10L 21/0208; G10L 21/0216; G10L 21/0224; G10L 21/0232; G10L 21/0264

USPC ..... 704/226–228, 233

See application file for complete search history.

(56) References Cited

U.S. PATENT DOCUMENTS 6,023,674 A * 2/2000 Mekuria ..... 704/233
6,122,610 A 9/2000 Isabelle (Continued)

FOREIGN PATENT DOCUMENTS

EP 1635331 A 3/2006
WO 2006/114101 A 11/2006

OTHER PUBLICATIONS

Cohen, I., "Noise spectrum estimation in adverse environments: improved minima controlled recursive averaging," Speech and Audio Processing, IEEE Transactions on , vol. 11, No. 5, pp. 466,475, Sep. 2003.*

(Continued)

*Primary Examiner* — Matthew Baker

(74) *Attorney, Agent, or Firm* — John W. Branch; Lowe Graham Jones PLLC

(57) ABSTRACT

A signal processor for estimating noise power in an audio signal includes a filter unit for generating a series of power values, each power value representing the power in the audio signal at a respective one of a plurality of frequency bands; a signal classification unit for analysing successive portions of the audio signal to assess whether each portion contains features characteristic of speech, and for classifying each portion in dependence on that analysis; a correction unit for estimating a minimum power value in a time-limited part of the audio signal, estimating the total noise power in that part of the audio signal and forming a correction factor dependent on the ratio of the minimum power value to the estimated total noise power, the correction unit being configured to estimate the minimum power value and the total noise power over only those portions of the time-limited part of the signal that are classified by the signal classification unit as being less characteristic of speech; and a noise estimation unit for estimating noise in the audio signal in dependence on the power values output by the filter unit and the correction factor formed by the correction unit.

46 Claims, 3 Drawing Sheets

(56) References Cited

U.S. PATENT DOCUMENTS

| | | | | |
|---|---|---|---|---|
| 6,459,914 | B1 | 10/2002 | Gustafsson et al. | |
| 6,529,868 | B1 * | 3/2003 | Chandran et al. | 704/226 |
| RE38,269 | E * | 10/2003 | Liu | 704/227 |
| 6,810,273 | B1 * | 10/2004 | Mattila et al. | 455/570 |
| 6,862,567 | B1 * | 3/2005 | Gao | 704/228 |
| 6,980,950 | B1 * | 12/2005 | Gong et al. | 704/210 |
| 7,031,916 | B2 * | 4/2006 | Li et al. | 704/233 |
| 7,043,428 | B2 * | 5/2006 | Li | 704/233 |
| 7,117,148 | B2 * | 10/2006 | Droppo et al. | 704/228 |
| 7,181,390 | B2 * | 2/2007 | Droppo et al. | 704/226 |
| 7,447,630 | B2 * | 11/2008 | Liu et al. | 704/228 |
| 7,590,530 | B2 * | 9/2009 | Zhao et al. | 704/226 |
| 7,680,653 | B2 * | 3/2010 | Yeldener | 704/227 |
| 7,873,114 | B2 * | 1/2011 | Lin | 375/285 |
| 7,912,231 | B2 * | 3/2011 | Yang et al. | 381/94.2 |
| 8,015,002 | B2 * | 9/2011 | Li et al. | 704/226 |
| 8,364,479 | B2 * | 1/2013 | Schmidt et al. | 704/228 |
| 8,412,520 | B2 * | 4/2013 | Furuta et al. | 704/226 |
| 8,571,231 | B2 * | 10/2013 | Ramakrishnan et al. | 381/94.2 |
| 8,577,675 | B2 * | 11/2013 | Jelinek | 704/225 |
| 2005/0027520 | A1 * | 2/2005 | Mattila et al. | 704/228 |
| 2007/0055508 | A1 * | 3/2007 | Zhao et al. | 704/226 |
| 2008/0140395 | A1 * | 6/2008 | Yeldener | 704/226 |
| 2008/0243496 | A1 * | 10/2008 | Wang | 704/226 |
| 2008/0281589 | A1 * | 11/2008 | Wang et al. | 704/226 |
| 2009/0254340 | A1 * | 10/2009 | Sun et al. | 704/226 |

OTHER PUBLICATIONS

Z. Lin , R. A. Goubran and R. M. Dansereau "Noise estimation using speech/non-speech frame decision and subband spectral tracking", Speech Commun., vol. 49, pp. 542-557 2007.*

Rangachari, Sundarrajan, and Philipos C. Loizou. "A noise-estimation algorithm for highly non-stationary environments." Speech communication 48.2 (2006): 220-231.*

Rangachari, Sundarrajan, Philipos C. Loizou, and Yi Hu. "A noise estimation algorithm with rapid adaptation for highly nonstationary environments." Acoustics, Speech, and Signal Processing, 2004. Proceedings.(ICASSP'04). IEEE International Conference on. vol. 1. IEEE, 2004.*

Lin, L.; Holmes, W.H.; Ambikairajah, E.; , "Adaptive noise estimation algorithm for speech enhancement," Electronics Letters , vol. 39, No. 9, pp. 754-755, May 1, 2003 doi: 10.1049/el:20030480.*

Martin, R.; , "Noise power spectral density estimation based on optimal smoothing and minimum statistics," Speech and Audio Processing, IEEE Transactions on , vol. 9, No. 5, pp. 504-512, Jul. 2001 doi: 10.1109/89.928915 URL: http://ieeexplore.ieee.org/stamp/stamp.jsp?tp=&arnumber=928915&isnumber=20081.*

Li Hui; Bei-qian Dai; Lu Wei; , "A Pitch Detection Algorithm Based on AMDF and ACF," Acoustics, Speech and Signal Processing, 2006. ICASSP 2006 Proceedings. 2006 IEEE International Conference on , vol. 1, no., pp. I, May 14-19, 2006 doi: 10.1109/ICASSP.2006.1660036 URL: http://ieeexplore.ieee.org/stamp/stamp.jsp?tp=&arnumber=1660036&isnumber=34757.*

Zhong Lin; Goubran, R.; , "Instant Noise Estimation Using Fourier Transform of AMDF and Variable Start Minima Search," Acoustics, Speech, and Signal Processing, 2005. Proceedings. (ICASSP '05). IEEE International Conference on , vol. 1, no., pp. 161-164, Mar. 18-23, 2005 doi: 10.1109/ICASSP.2005.1415075.*

Zhong et al., "Instant Noise Estimation Using Fourier Transform of AMDF and Variable Start Minima Search," 2005 IEEE International Conference on Acoustics, Speech, and Signal Processing, Mar. 18, 2005, pp. 161-164, vol. 1, IEEE, Piscataway, NJ.

Cohen, "Noise Spectrum Estimation in Adverse Environments: Improved Minima Controlled Recursive Averaging," IEEE Transactions on Speech and Audio Processing, Sep. 1, 2003, pp. 466-475, vol. 11, No. 5, IEEE Service Center, New York, NY.

Tilp, "Verfahren zur Verbesserung gestoerter Sprachsignale unter Beruecksichtigung der Gundfrequenz stimmhafter Sprachlaute," VDI Verlag, 2002, sections 2.3.2, 2.3.4, 0178-9627, Duesseldorf, Germany.

David Malah, et al., "Tracking Speech-Presence Uncertainty to Improve Speech Enhancement in Non-Stationary Noise Environments," AT&T Labs-Research, Florham Park, NJ 07932.

* cited by examiner

| *State* | *Condition* | *Action* | |
|---|---|---|---|
| *State 1* | if $C < T_1$ then | $P_k(l) = \frac{P_k(l)C}{T_1}$ | (16) |
| *State 2* | else if $T_1 \le C \le 1$ then | do nothing | |
| *State 3* | else if $1 < C \le T_2$ then | $P_k(l) = P_k(l)C$ | (17) |
| *State 4* | else | $P_k(l) = \frac{P_{\min,g}(l)}{N_g}$ where $N_g$ is the number of frequency bins in group $g$ | (18) |
| | end if | | |

FIG. 3

| *State* | *Condition* | *Action* |
|---|---|---|
| *State 1* | if $q \le Q_S$ then | $\beta = \beta_{\min}$ |
| *State 2* | else if $Q_S < q \le Q_N$ then | $\beta = \frac{(\beta_{\max} - \beta_{\min})(q - Q_S)}{Q_N - Q_S}$ (22) |
| *State 3* | else | $\beta = \beta_{\max}$ |
| | end if | |

FIG. 4

NOISE REDUCTION

BACKGROUND OF THE INVENTION

This invention relates to estimating features of a signal, particularly for the purpose of reducing noise in the signal. The features could be noise power and gain. The signal could be an audio signal.

There are many types of devices that detect and process speech signals. Examples include headsets and mobile phones. In those devices it is often desired to reduce the noise in the detected signal in order to more accurately represent the speech component of the signal. For instance, in a mobile phone or a headset any audio that is detected by a microphone may include a component representing a user's speech and a component arising from ambient noise. If that noise can be removed from the detected signal then the signal can sound better when it is played out, and it might also be possible to compress the signal more accurately or more efficiently. To achieve this, the noise component of the detected audio signal must be separated from the voice component.

If a speech signal s(n) is corrupted by additive background noise v(n), the resulting noisy speech signal d(n) can be expressed in the time domain as:

$$d(n)=s(n)+v(n) \tag{1}$$

The objective of noise reduction in such a situation is normally to estimate v(n) and subtract it from d(n) to find s(n).

One algorithm for noise reduction operates in the frequency-domain. It tackles the noise reduction problem by employing a DFT (discrete Fourier transform) filter bank and tracking the average power of quasi-stationary background noise in each sub-band from the DFT. A gain value is derived for each sub-band based on the noise estimates, and those gain values are applied to each sub-band to generate an enhanced time domain signal in which the noise is expected to be reduced. FIG. 1 illustrates this algorithm by a block diagram. The incoming signal d(n) is received at 1. It is applied to a series of filters 2, each of which outputs a respective sub-band signal representing a particular sub-band of the incoming signal. Each of the sub-band signals is input to a downsampling unit 3 which downsamples the sub-band signal to average its power. The outputs of the downsampling units 3 form the output of the analysis filter bank (AFB) 5. Those outputs signals are noisy signals $D_k$ (k=0 . . . M−1). Each of those signals is subsequently multiplied by $G_{oms,k}$ in a multiplication unit 6. $G_{oms,k}$ is an estimated gain value that will be discussed in more detail below. Then the enhanced time domain signal is obtained by passing the multiplication results through a synthesis filter bank (SFB). In the SFB 7 upsampling units 8 upsample the outputs of the multiplication units, the outputs of the upsampling units are applied to respected synthesis filters 9 which each re-synthesise a signal representing the respective sub-band, and then the outputs of the synthesis filters are added to form the output signal.

In general, it can be assumed that the speech signal and the background noise are independent, and thus the power of the noisy speech signal is equal to the power of the speech signal plus the power of background noise in each sub-band k $$|D_k|^2=|S_k|^2+|V_k|^2. \tag{2}$$

If the noise power is known then an estimate of the speech power can be got from:

$$|S_k|^2=|D_k^2-|V_k|^2, \tag{3}$$

It is necessary to estimate the gain in order to generate the signals $G_{oms,k}$. One of the most widely used methods of estimating gain is by means of the optimal Wiener filter gain, which is computed as $$G_{wiener,k} = \max\left(1 - \frac{|V_k|^2}{|D_k|^2}, 0\right). \tag{4}$$

The estimated clean speech signal in each sub-band, $\hat{S}_k$, is then simply derived as $$\hat{S}_k=G_{wiener,k}\cdot D_k. \tag{5}$$

It can be identified that the estimation of noise power ($|V_k|^2$) and gain ($G_{oms}$) is crucial to the success of the algorithm. Unfortunately, obtaining reliable estimates of these has shown to be extremely difficult in the past due to the high complexity of various noisy environments. Many algorithms perform well in one situation but fail in other situations. Since the nature of the environment is not normally known in advance, and may change as a user moves from place to place, many algorithms provide inconsistent and unsatisfactory results.

SUMMARY OF THE INVENTION

It would therefore be valuable to have an improved mechanism for estimating noise power in a signal.

According to aspects of the present invention there are provided signal processing apparatus and methods as set out in the accompanying claims.

BRIEF DESCRIPTION OF THE DRAWINGS

The present invention will now be described by way of example with reference to the accompanying drawings, in which:

FIG. 3 shows a state machine for using minimum statistics; and

FIG. 4 shows a state machine for determining the value of an over-subtraction factor.

DETAILED DESCRIPTION OF THE INVENTION

Figure 1:
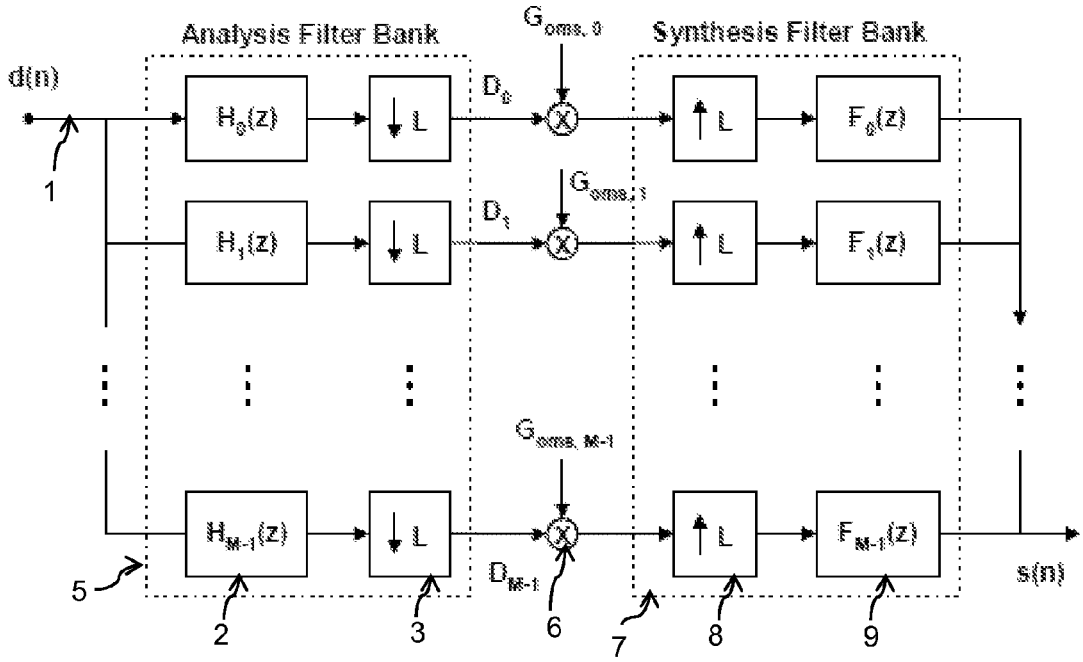
FIG. 1 is a block diagram showing a mechanism for reducing noise in a signal.

The system described below estimates noise in an audio signal by means of an adaptive system having cascaded controller blocks.

This example will be described in the context of a device for estimating noise in a source audio signal. FIG. 2 shows the general logical architecture that will be employed. The source audio signal d(n) will be applied to an analysis filter bank (AFB) 10 analogous to that shown in FIG. 1 and to a harmonicity estimation unit 11 which generates an output dependent on the estimated harmonicity of the source signal. The outputs of the analysis filter bank 10 and the harmonicity estimation unit 11 are provided to a statistical analysis unit 12 which generates minimum statistics information. The statistical analysis unit processes the output of the AFB in a manner that is dependent on the output of the harmonicity estimation unit. The outputs of the analysis filter bank 10 and the statistical analysis unit are applied to an adaptive noise estimation unit 13 which adaptively estimates the noise in each sub-band of the signal by processing the output of the AFB in a manner that is dependent on the output of the statistical analysis unit.

Let a noise power estimate be denoted by $P_k(l)$, where k is the sub-band index and l is the frame index of the data frame under consideration after processing by the analysis filter bank 10 with downsampling rate L. As shown by FIG. 2, $P_k(l)$ is obtained after the input signal passes through the AFB and though the adaptive noise estimation unit 13. In parallel with the AFB are the modules 11 and 12. The dashed arrows in FIG. 2 indicate that the outputs of modules 11 and 12 control the operation of the units to which they are input.

For better illustration, in the following the operation of the modules 10 to 13 will be described in reverse order.

Adaptive Noise Estimation Module

Noise power $P_k(l)$ is commonly estimated by applying a first-order IIR filter to the noisy signal power:

$$P_k(l)=P_k(l-1)+\alpha(|D_k(l)|^2-P_k(l-1)), \tag{6}$$

where the parameter $\alpha$ is a constant between 0 and 1 that sets the weight applied to each frame, and hence the effective average time.

Adaptive noise estimation is achieved by weighting $\alpha$ in equation (6) dynamically with a speech absence probability (SAP) model. That model is described below.

Let $H_0$ be the hypothesis of speech absence; then the speech absence probability (SAP) given an input signal in the frequency domain (D) is $p(H_0|D)$. For simplicity, time and frequency indices will be ignored in the description below. Applying Bayes' rule one obtains:

$$p(H_0 \mid D) = \frac{p(D \mid H_0)p(H_0)}{p(D)}. \tag{7}$$

Assuming $$p(H_0) = \lambda, \tag{8}$$

where $\lambda$ is a constant between 0 and 1, inclusive, then for a complex Gaussian distribution of DFT coefficients (D), we have $$p(D) = \frac{1}{\pi\sigma_D^2}\exp\left(-\frac{|D|^2}{\sigma_D^2}\right), \tag{9}$$

and $$p(D \mid H_0) = \frac{1}{\pi P}\exp\left(-\frac{|D|^2}{P}\right), \tag{10}$$

where $\sigma_D^2$ is the variance of D. (See Vary, P.; Martin, R. *Digital Speech Transmission. Enhancement, Coding and Error Concealment*, John Wiley-Verlag, 2006; Y. Ephraim and D. Malah, "Speech enhancement using a minimum mean-square error log-spectral amplitude estimator," IEEE Trans. Acoustics, Speech and Signal Processing, vol. ASSP-33, pp. 443-445, 1985; and I. Cohen, "Noise Spectrum Estimation in Adverse Environments: Improved Minima Controlled Recursive Averaging," IEEE Trans. Speech and Audio Processing, vol. 11, pp. 466-475, September 2003).

Combining equations 7 to 10 gives the conditional speech absence probability as being:

$$p(H_0 \mid D) = \frac{\sigma_D^2}{P}\exp\left(\frac{|D|^2}{\sigma_D^2} - \frac{|D|^2}{P}\right)\lambda, \tag{11}$$

By substituting $\sigma_D^2$ with instantaneous signal power $|D|^2$, and also adding additional constraints to differentiate between different conditions, equation 11 can be re-written as $$q_k(l) = \begin{cases} \frac{|D_k(l)|^2}{P_k(l)}\exp\left(1 - \frac{|D_k(l)|^2}{P_k(l)}\right)\lambda, & \text{if } |D_k(l)|^2 > P_k(l) \\ \lambda, & \text{otherwise} \end{cases} \tag{12}$$

and the noise power estimation becomes $$P_k(l)=P_k(l-1)+\alpha q_k(l)(|D_k(l)|^2-P_k(l-1)). \tag{13}$$

It can be observed that $q_k(l)$ reaches $\lambda$ only when $|D_k(l)|^2$ is equal to $P_k(l)$, and approaches 0 when their difference increases. This feature allows smooth transitions to be tracked but prevents any dramatic variation from affecting the noise estimate. Note that setting $q_k(l)$to $\lambda$ when $|D_k(l)|^2$ is smaller than $P_k(l)$ enables full speed noise adaptation which can preserve weak speech segments better as it reduces the weight of previous noise estimates. The drawback of this is the noise estimates are biased toward lower values that results in less noise reduction. This can be mitigated in a manner described below.

The SAP model in equations 12 is derived from the energy ratio between a noisy speech signal and estimated noise within each individual frequency band. It does not take advantage of the following known facts:

Voiced speech signals usually have a harmonic structure.

Speech signals have a distinct formant structure.

By supposing that noise under consideration does not have those structures characteristic of speech, a more effective SAP model can be derived to detect speech or noise. One option is to modify equations 12 to incorporate cross-band averaging, in the following way:

$$R_k(l) = \frac{\sum_{j=k-b(k)}^{k+b(k)} |D_j(l)|^2}{\sum_{j=k-b(k)}^{k+b(k)} P_j(l)}, \tag{14}$$

$$q_k(l) = R_k(l)\exp(1 - R_k(l))\lambda, \tag{15}$$

where b(k) is a predefined bandwidth value for sub-band k.

Such cross-band averaging results in greater variance reduction on noise than on speech, and makes the SAP model more robust. However, excessive averaging (i.e. a value of b(k) that is too large) will reduce both frequency and time resolution, which can cause significant speech distortion. To avoid this bandwidth values should be selected to be in-keeping with the formants present in speech, for example:

(1) By increasing bandwidth values with increasing frequency, since formant bandwidth generally increases with formant frequency.

(2) By using relatively narrower bandwidth for the regions of the first and second formants, since these regions are more important to speech intelligibility.

Speech absence probability can alternatively be estimated by other voice activity detection algorithms, conveniently those that output SAP based on input signal power information.

Statistical Analysis Module

Adaptive noise estimation performed as described above may need a long time to converge when there is a sudden change of noise floor. One possible solution is to use minimum statistics to correct noise estimation. (See Rainer Martin, "Noise power spectral density estimation based on optimal smoothing and minimum statistics," IEEE Transactions on speech and audio processing, vol. 9, no. 5, pp. 504-512, July 2001; Myron J. Ross, Harry L. Shaffer, Andrew Cohen, Richard Freudberg).

The approach employed in the present system essentially involves searching for a minimum value either:

(a) in the time domain; or (b) in the frequency domain within a time frame, and then using this value or its derivative as the noise estimates.

In the present system, minimum statistics are used to control the adaptive noise estimator, whereby the requirement for high frequency resolution can be greatly relaxed. Specifically, instead of performing minimum tracking in each sub-band, we group frequency bins into several subsets and obtain one minimum value for each subset. The benefit of grouping is two-fold: (1) it reduces system complexity and resource cost; and (2) it smoothes out unwanted fluctuation. Without loss of generality, we split the spectrum into two groups in our implementation, which span low frequency and high frequency regions, respectively. More groups could be used, and non-adjacent portions of the frequency spectrum could be combined in a single group. For each group, a fixed length FIFO (first-in first-out) queue is formed by taking the summation of noisy signal power ($|D_k(l)|^2$) for each frame. Finally one minimal value is identified for each queue.

Minimum statistics are used in the following way to aid adaptive noise estimation. Let $P_{min,g}(l)$ be the minimum power value for group g at frame index l determined in the manner described above, and let $P_{sum,g}(l)$ represent the total estimated noise power for group g at frame l. Then a correction factor C is derived as $$C = \frac{P_{\min,g}(l)}{P_{sum,g}(l)}. \tag{16}$$

The control of noise estimation using minimum statistics is realized through applying this correction factor to the noise estimates $P_k(l)$.

To take further advantage of minimum statistics information, a more complex scheme can be used. The range of C $\{C \geq 0\}$ can be divided into four zones by defining two threshold values $T_1$ and $T_2$, where $T_1 < 1 < T_2$. Then a state machine is implemented as shown in FIG. 3.

When the minimum $P_{min,g}(l)$ is only slightly lower than estimated noise power $P_{sum,g}(l)$ as in state 2 ($T_1 \leq C \leq 1$), nothing needs to be done because this is fully expected. However, if the minimum value is significantly smaller than noise estimate as in state 1 ($C < T_1$) then a correction is triggered. State 1 corresponds to a condition where noise becomes mistakenly adapted to speech level or there is a sudden drop of noise floor. To avoid over-adjustment, the correction factor C is normalized by $T_1$ so that the corrected noise estimates are still higher than the minimum value. When $P_{min,g}(l)$ is greater than $P_{sum,g}(l)$ as in state 3 ($1 < C \leq T_2$), simple correction is applied as there might be a sudden jump of noise floor and our noise estimate is lagging behind. Special treatment is needed when the minimum value ($P_{min,g}(l)$) is significantly higher than the noise estimate ($P_{sum,g}(l)$) as in state 4 ($C > T_2$). A plain correction of multiplying by the correction factor may run into problems when there is a substantial spectrum mismatch between the old noise floor and the new noise floor. It may take very long time to converge to the new noise spectrum. Or, even more problematically, narrow band noise could be produced which might well create annoying audio artefacts. This is addressed in the state machine of FIG. 3 by resetting noise estimates to white spectrum for each group, as shown in equation 18. This employs the property that when the noise floor change is too extreme using the evenly distributed spectrum may well result in quick convergence.

Harmonicity Module

The minimum-search window duration has a crucial impact on noise estimation. A short window allows faster response to noise variation but may also misclassify speech as noise when continuous phonation is longer than the window length. A long window on the other hand will slow down noise adaptation. One approach is to define an advantageous window length empirically, but this may not suit a wide range of situations. Instead, the present system employs a dynamic window length which can vary during operation. In this example the window length is controlled by speech harmonicity (periodicity).

There are many ways to determine harmonicity of speech. AMDF (Average Magnitude Difference Function) is one method, and is described in Harold J. Manley; Average magnitude difference function pitch extractor, IEEE Trans. Acoust., Speech, Signal Processing, vol. 22, pp. 353-362, October 1974. A variant of AMDF is CAMDF (Cross Average Magnitude Difference Function). CAMDF has been found to be relatively efficient and to provide relatively good performance.

For a short-term signal x(n) {n:0 . . . N−1} CAMDF can be defined as below:

$$CAMDF(\tau) = \sum_{i=0}^{U-1} |x(i) - x(i+\tau)|, \tag{19}$$

where $\tau$ is the lag value that is subject to the constraint $0 < \tau \leq N-U$.

One representation of harmonicity based on CAMDF can simply be the ratio between its minimum and maximum:

$$H = \frac{\min\limits_{\tau=0\ldots N-U}(CAMDF(\tau))}{\max\limits_{\tau=0\ldots N-U}(CAMDF(\tau))}. \tag{20}$$

A harmonicity value is conventionally used directly to determine voicing status. However, its reliability degrades significantly in a high noise environment. On the other hand, under medium to high SNR conditions, harmonicity offers some unique yet important information previously unavailable to adaptive noise estimation and minimum statistics which exploit mostly energy variation patterns. The present system uses harmonicity to control the manner of operation of the statistical analysis module. Specifically, when a frame is classified as voiced by the harmonicity function, it is skipped by the minimum statistics calculation. This is equivalent to lengthening the minimum search window duration when speech is present. As a result, the default search duration can be set relatively short for fast noise adaptation.

The harmonicity detector/module can be alternatively implemented through other pitch detectors described in the literature, for example by auto-correlation. However, it is preferable to use a simpler method than fully-fledged pitch detection since pitch detection is computationally intensive. Alternatives include determining any one or more of harmonicity, periodicity and voicing and/or by analysing over a partial pitch range. If voicing is used then the detector need not perform any pitch detection.

Instant Noise Estimation Using Fourier Transform of AMDF and Variable Start Minima Search [Zhong Lin; Goubran, R.; Acoustics, Speech, and Signal Processing, 2005. Proceedings. (ICASSP apos;05). Volume 1, Issue, Mar. 18-23, 2005 Page(s): 161-164 discloses a speech processor that employs a speech detector based on Fourier Transform of AMDF that running in parallel with Variable Start Minima Search. Such a parallel approach—unlike the cascading approach described herein—increases the system's sensitivity to speech detector failures and can be computationally less efficient.

Hybrid Gain from Wiener Filter with Over-Subtraction and MMSE-LSA

Gain calculated based on the Wiener filter in equation 4 often results in musical noise. One of the commonly used solutions is to use over-subtraction during gain calculation as shown below.

$$G_{wiener,k}(l) = \max\left(1 - \frac{\beta P_k(l)}{|D_k(l)|^2}, 0\right), \tag{21}$$

where $\beta$ is the over-subtraction factor.

As mentioned earlier, the noise estimate $P_k(l)$ in the present system can be found to be biased toward lower values. Thus, using over-subtraction also compensates noise estimation to achieve greater noise reduction.

In the present system, an adaptive over-subtraction scheme is used, which is based on the SAP obtained as described above. First, let $\beta_{min}$ and $\beta_{max}$ be the minimum and maximum over-subtraction values, respectively. Then in a similar manner to the analysis performed in the statistical analysis module described above, and ignoring time and frequency subscripts for simplicity, we divide the range of speech absence probability q into three zones by defining two threshold values $Q_S$ and $Q_N$ such that $0<Q_S<Q_N<1$. This represents a crude categorization of SAP into speech only, speech mixed with noise, and noise only states, respectively. Finally we use a state machine to determine the value of over-subtraction factor $\beta$. The state machine is illustrated in FIG. 4.

In state 1 (speech only) or state 3 (noise only), $\beta$ is simply set to the pre-determined minimum or the maximum over-subtraction values respectively. In state 2 which corresponds to a mixed speech and noise condition, $\beta$ is calculated by linear interpolation between $\beta_{min}$ and $\beta_{max}$ based on SAP q. With properly selected threshold values, over-subtraction can effectively suppress musical noise and achieve significant noise reduction overall.

To further suppress musical noise, additional processing is applied to the instantaneous gain $G_{wiener,k}(l)$.

Because noise is a random process, the true noise power at any instance varies around the noise estimate $P_k(l)$. When $G_{wiener,k}(l)$ is much larger than $P_k(l)$, the fluctuation of noise power is minor compared to $|D_k(l)|^2$, and hence $G_{wiener,k}(l)$ is very reliable and its normalized variance is small. On the other hand, when $|D_k(l)|^2$ approximates $P_k(l)$, the fluctuation of noise power becomes significant, and hence $G_{wiener,k}(l)$ is unreliable and its normalized variance is large. If $G_{wiener,k}(l)$ is left without further smoothing, the large normalized variance in low SNR periods would cause musical or watering artefacts. However, if a constant average rate is used to suppress these artefacts, it would cause over smoothing in high SNR periods and thus results in tonal or ambient artefacts. To achieve the same normalized variation for the gain factor, the average rate needs to be proportional to the square of the gain. Therefore the final gain factor $G_k(l)$ is computed by smoothing $G_{wiener,k}(l)$ with the following algorithm:

$$G_k(l)=G_k(l-1)+(\alpha_G \cdot G_{0,k}^2(l))(G_{weiner,k}(l)-G_k(l-1)), \tag{23}$$

$$G_{0,k}(l)=G_k(l-1)+0.25(G_{wiener,k}(l)-G_k(l-1)), \tag{24}$$

where $\alpha_G$ is a time constant between 0 and 1, and $G_{0,i}(k)$ is a pre-estimate of $G_k(l)$ based on the latest gain estimate $G_k(l-1)$ and the instantaneous Wiener gain $G_{0,k}(l)$. Using a variable average rate $G_{0,k}^2(l)$, and specifically one based on a pre-estimate of the moderated Wiener gain value, to smooth the Wiener gain can help regulate the normalized variance in the gain factor $G_k(l)$ It can be observed that $G_k(l)$ is averaged over a long time when it is close to 0, but is with very little average when it approximates 1. This creates a smooth noise floor while avoiding generating ambient-sounding (i.e. thin, watery-sounding) speech.

While over-subtraction and gain smoothing create a smooth noise floor and achieve significant noise reduction, they could also cause speech distortion, particularly on weak speech components. To improve voice quality, we choose MMSE-LSA gain function described in Ephraim and D. Malah to replace equation 21 for certain conditions which will be specified later.

The formulation of MMSE-LSA is described below.

First, define:

$$\gamma_k(l) \triangleq \frac{|D_k(l)|^2}{P_k(l)}, \tag{25}$$

$$\xi_k(l) \triangleq \frac{\hat{S}_k(l)}{P_k(l)}, \tag{26}$$

where $\gamma$ is the a posteriori SNR, and $\xi$ is the a priori SNR.

Then the MMSE-LSA gain function is:

$$G_{LSA}(\xi, \gamma) = \frac{\xi}{1+\xi}\exp\left(\frac{1}{2}\int_{\upsilon}^{\infty}\frac{e^{-t}}{t}dt\right), \tag{27}$$

where $$\upsilon = \frac{\xi}{1+\xi}\gamma.$$

In MMSE-LSA, a priori SNR $\xi$ is the dominant factor, which enables filter to produce less musical noise and better voice quality. However, because of the diminishing role of a posteriori SNR $\gamma$, on which the over-subtraction can be applied, the noise reduction level of MMSE-LSA is limited. For this reason the present system only uses MMSE-LSA for speech dominant frequency bands of voiced frames. This is because on those frames: (1) speech quality matters most, and (2) less noise reduction may be tolerable as some noise components might be masked by stronger speech components.

Results

Tests using the system described above have indicated that the system can achieve over 20 dB noise reduction while preserving high voice quality. The system has been found to perform well from quiet to high noise conditions. It has also been found to have a fast convergence time of less than 0.5 seconds in some typical environments. These results place it among the best currently available algorithms for single microphone noise reduction performance.

Figure 2:
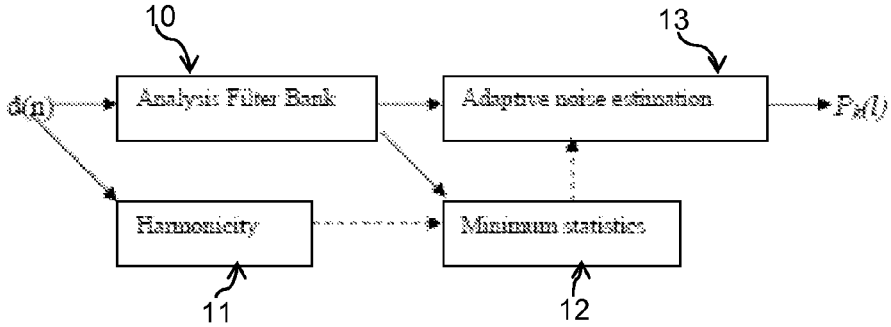
FIG. 2 is a block diagram showing a mechanism for estimating noise power in a signal.

The system described above can be used to estimate noise power and/or gain for use in a noise reduction system of the type shown in FIG. 1, or in another such system, or for other purposes such as identifying an environment from its noise characteristics.

The system described above can be implemented in any device that processes audio data. Examples include headsets, phones, radio receivers that play back speech signals and stand-alone microphone units.

The system described above could be implemented in dedicated hardware or by means of software running on a microprocessor. The system is preferably implemented on a single integrated circuit.

The inventors hereby disclose in isolation each individual feature described herein and any combination of two or more such features, to the extent that such features or combinations are capable of being carried out based on the present specification as a whole in the light of the common general knowledge of a person skilled in the art, irrespective of whether such features or combinations of features solve any problems disclosed herein, and without limitation to the scope of the claims. The inventors indicate that aspects of the present invention may consist of any such individual feature or combination of features. In view of the foregoing description it will be evident to a person skilled in the art that various modifications may be made within the scope of the invention.

The invention claimed is:

1. A signal processor for estimating noise power in an audio signal, the signal processor comprising:

a filter module adapted to receive an audio signal and to generate a series of power values, each power value representing the power in the audio signal at a respective one of a plurality of frequency bands;

a signal classification module adapted to receive said audio signal and to analyze successive portions of the audio signal to assess whether each portion contains features characteristic of speech using a voice activity detection algorithm, and to classify each portion in dependence on that analysis;

a correction module adapted to:

receive said power values;

generate a minimum power value for each of a plurality of frequency groups in a time-limited part of the audio signal, wherein each of the plurality of frequency groups includes a plurality of frequency bins;

estimate the total noise power for each of the plurality of frequency groups in the time-limited part of the audio signal; and form a correction factor dependent on the ratio of the minimum power value to the estimated total noise power for a respective frequency group; and a noise estimation module adapted to estimate noise in the audio signal in dependence on the power values output by the filter module and the correction factor formed by the correction module for each frequency group, wherein the power values, the correction factor, and a number of frequency bins for a frequency group are employed to determine the noise estimation for the frequency group based on a plurality of states defined by a relationship between the correction factor and at least three threshold values; and wherein the plurality of states comprise:

when the correction factor for the frequency group is below a first threshold, then the noise estimation is determined based on the product of the power values and the correction factor for the frequency group normalized by the first threshold;

when the correction factor for the frequency group is greater than the first threshold and less than one, then the noise estimation is ignored;

when the correction factor for the frequency group is greater than one and less than a second threshold, then the noise estimation is determined based on the product of the power values and the correction factor; and when the correction factor for the frequency group is greater than the second threshold, then the noise estimation is determined based on the minimum power value for the frequency group divided by a number of frequency bins in the frequency group.

2. A signal processor as claimed in claim 1, wherein the filter module implements a Fourier transform.

3. A signal processor as claimed in claim 1, wherein the signal classification module is configured to analyse the portions of the audio signal to detect harmonicity therein and to classify each portion in dependence on that analysis.

4. A signal processor as claimed in claim 1, wherein the signal classification module is configured to analyze the portions of the audio signal to detect pitch characteristics therein and to classify each portion in dependence on that analysis.

5. A signal processor as claimed in claim 1, wherein the minimum power is the minimum power of a plurality of time domain samples derived from the time-limited part of the audio signal.

6. A signal processor as claimed in claim 1, wherein the minimum power is the minimum power of a plurality of frequency domain samples derived from the time-limited part of the audio signal.

7. A signal processor as claimed in claim 1, wherein the minimum power is derived from the minimum power of a plurality of time domain samples derived from the time-limited part of the audio signal.

8. A signal processor as claimed in claim 1, wherein the minimum power is derived from the minimum power of a plurality of frequency domain samples derived from the time-limited part of the audio signal.

9. A signal processor as claimed in claim 1, wherein in a first mode of operation the noise estimation module is configured to estimate noise in the audio signal as the product of the power values output by the filter module and the correction factor formed by the correction module divided by a predetermined scaling factor that is greater than one.

10. A signal processor as claimed in claim 9, wherein, if the correction factor is below a first predetermined threshold, the noise estimation module is configured to operate in the first mode of operation .

11. A signal processor as claimed in claim 1, wherein, if the correction factor formed by the correction function is between a first threshold and a second threshold in a first mode of operation, the noise estimation module is configured to estimate noise in the audio signal as the power values output by the filter module.

12. A signal processor as claimed in claim 1, wherein in a first mode of operation the noise estimation module is configured to estimate noise in the audio signal as the product of the power values output by the filter module and the correction factor formed by the correction module.

13. A signal processor as claimed in claim 12, wherein, if the correction factor is between a first threshold and a second threshold, the noise estimation module is configured to operate in the first mode of operation.

14. A signal processor as claimed in claim 9, wherein in a second mode of operation the noise estimation module is configured to estimate noise in the audio signal in dependence on the estimated minimum power value divided by a representation of the breadth of the frequency spectrum that contributed to that value.

15. A signal processor as claimed in claim 14, wherein, if the correction factor is above a first predetermined threshold, the noise estimation module is configured to operate in the second mode of operation.

16. A method for estimating noise power in an audio signal, the method comprising:

generating a series of power values, each power value representing the power in the audio signal at a respective one of a plurality of frequency bands;

analyzing successive portions of the audio signal using a voice activity detection algorithm to assess whether each portion contains features characteristic of speech, and classifying each portion in dependence on that analysis;

estimating a minimum power value for each of a plurality of frequency groups in a time-limited part of the audio signal, wherein each of the plurality of frequency groups includes a plurality of frequency bins;

estimating the total noise power for each of the plurality of frequency groups in the time-limited part of the audio signal;

forming a correction factor dependent on the ratio of the minimum power value to the estimated total noise power for a respective frequency group; and estimating noise in the audio signal in dependence on the estimated power values and the formed correction factor for each frequency group, wherein the estimated power values, the correction factor, and a number of frequency bins for a frequency group are employed to determine the noise estimation for the frequency group based on a plurality of states defined by a relationship between the correction factor and at least three threshold values; and wherein the plurality of states comprise:

when the correction factor for the frequency group is below a first threshold, then the noise estimation is determined based on the product of the power values and the correction factor for the frequency group normalized by the first threshold;

when the correction factor for the frequency group is greater than the first threshold and less than one, then the noise estimation is ignored;

when the correction factor for the frequency group is greater than one and less than a second threshold, then the noise estimation is determined based on the product of the power values and the correction factor; and when the correction factor for the frequency group is greater than the second threshold, then the noise estimation is determined based on the minimum power value for the frequency group divided by a number of frequency bins in the frequency group.

17. A method as claimed in claim 16, wherein the step of generating a series of power values comprises implementing a Fourier transform.

18. A method as claimed in claim 16, comprising analysing the portions of the audio signal to detect harmonicity therein and classifying each portion in dependence on that analysis.

19. A method as claimed in claim 16, comprising analysing the portions of the audio signal to detect pitch characteristics therein and classifying each portion in dependence on that analysis.

20. A method as claimed in claim 16, wherein the minimum power is the minimum power of a plurality of time domain samples derived from the time-limited part of the audio signal.

21. A method as claimed in claim 16, wherein the minimum power is the minimum power of a plurality of frequency domain samples derived from the time-limited part of the audio signal.

22. A method as claimed in claim 16, wherein the minimum power is derived from the minimum power of a plurality of time domain samples derived from the time-limited part of the audio signal.

23. A method as claimed in claim 16, wherein the minimum power is derived from the minimum power of a plurality of frequency domain samples derived from the time-limited part of the audio signal.

24. A method as claimed in claim 16, comprising: in a first mode of operation estimating noise in the audio signal as the product of the power values and the correction factor divided by a predetermined scaling factor that is greater than one.

25. A method as claimed in claim 24, comprising operating in the first mode of operation if the correction factor is below a first predetermined threshold.

26. A method as claimed in claim 16, comprising: in a first mode of operation estimating noise in the audio signal as the power values if the correction factor is between a first threshold and a second threshold.

27. A method as claimed in claim 16, comprising: in a first mode of operation estimating noise in the audio signal as the product of the power values and the correction factor.

28. A method as claimed in claim 27, comprising operating in the first mode of operation if the correction factor is between a first threshold and a second threshold.

29. A method as claimed in claim 16, comprising: in a first mode of operation estimating noise in the audio signal in dependence on the estimated minimum power value divided by a representation of the breadth of the frequency spectrum that contributed to that value.

30. A method as claimed in claim 29, comprising operating in the first mode of operation if the correction factor is above a first predetermined threshold.

31. A signal processor for estimating noise in an audio signal, the signal processor comprising:

a frequency analysis module adapted to receive an audio signal and to periodically determine the power of the signal in each of a plurality of frequency ranges;

an aggregation module adapted to form a plurality of power data sets for each of a plurality of frequency groups that each include a plurality of frequency bins, each of the power data sets representing the powers determined by the frequency analysis module over a respective frequency range and over a time period, and each of the components of at least one of the power data sets being formed by combining the powers determined by the frequency analysis module for two or more frequency ranges;

a minimization module adapted to determine the minima of each of the power data sets for the plurality of frequency groups; and a noise estimation module for estimating noise in the audio signal, for each frequency group, in dependence on at least one correction factor that is based on the minima determined by the minimization module; wherein the power data sets, the correction factor, and a number of frequency bins for a frequency group are employed to estimate noise for the frequency group based on a plurality of states defined by a relationship between the correction factor and at least three threshold values; and wherein the plurality of states comprise:

when the at least one correction factor is below a first threshold, then noise estimation is determined based on a product of values for the powers and the at least one correction factor for a correction group that is normalized by the first threshold;

when the at least one correction factor is greater than the first threshold and less than one, then noise estimation is ignored;

when the at least one correction factor is greater than one and less than a second threshold, then noise estimation is determined based on the product of the values of the powers and the at least one correction factor; and when the at least one correction factor is greater than the second threshold, then noise estimation is determined based on the minima for the values of the powers divided by the number of frequency bins in the frequency group.

32. A signal processor as claimed in claim 31, wherein the noise estimation module is configured to estimate noise in the audio signal by forming one or more first noise estimates in dependence on the audio signal and modifying that/those first noise estimate(s) in dependence on the minima determined by the minimization module.

33. A signal processor as claimed in claim 31, wherein there are only two power data sets.

34. A signal processor as claimed in claim 31, wherein each of the components of all of the power data sets are formed by combining the powers determined by the frequency analysis module for two or more frequency ranges.

35. A signal processor as claimed in claim 31, wherein the frequency analysis module implements a Fourier transform.

36. A signal processor as claimed in claim 31, wherein the signal processor is configured to amplify each of the determined powers of the signal in each of the plurality of frequency ranges by a respective gain value, and re-synthesise an audio signal in dependence on the outputs of those amplifications so as to form a noise reduced signal.

37. A signal processor as claimed in claim 31, wherein each time period spans a plurality of frames and the minimization module is configured to determine the minima of each of the power data sets for a time period as being the minimum of the powers determined by the frequency analysis module over a respective frequency range for individual frames during that time period.

38. A signal processor as claimed in claim 31, wherein the or each of the power data sets that is formed by combining the powers determined by the frequency analysis module for two or more frequency ranges is formed by combining the powers determined by the frequency analysis module for adjacent frequency ranges.

39. A method for estimating noise in an audio signal, the method comprising: performing frequency analysis on the audio signal to periodically determine the power of the signal in each of a plurality of frequency ranges;

forming a plurality of power data sets for each of a plurality of frequency groups that each include a plurality of frequency bins, each of the power data sets representing the powers determined over a respective frequency range and over a time period, and each of the components of at least one of the power data sets being formed by combining the powers determined by the frequency analysis function for two or more frequency ranges;

determining the minima of each of the power data sets for the plurality of frequency groups; and for each frequency group, estimating noise in the audio signal in dependence on a correction factor that is based on the determined minima, wherein the power data sets, the correction factor, and a number of frequency bins for a frequency group are employed to estimate noise for the frequency group based on a plurality of states defined by a relationship between the correction factor and at least three threshold values; and wherein the plurality of states comprise:

when the correction factor for the frequency group is below a first threshold, then the noise estimation is determined based on the product of the power values and the correction factor for the frequency group normalized by the first threshold;

when the correction factor for the frequency group is greater than the first threshold and less than one, then the noise estimation is ignored;

when the correction factor for the frequency group is greater than one and less than a second threshold, then the noise estimation is determined based on the product of the power values and the correction factor; and when the correction factor for the frequency group is greater than the second threshold, then the noise estimation is determined based on the minima for the frequency group divided by the number of frequency bins in the frequency group.

40. A method as claimed in claim 39, comprising estimating noise in the audio signal by forming one or more first noise estimates in dependence on the audio signal and modifying that/those first noise estimate(s) in dependence on the determined minima

41. A method as claimed in claim 39, wherein there are only two power data sets.

42. A method as claimed in claim 39, wherein each of the components of all of the power data sets are formed by combining the powers determined for two or more frequency ranges.

43. A method as claimed in claim 39, wherein the step of performing frequency analysis comprises implementing a Fourier transform.

44. A method as claimed in claim 39, comprising amplifying each of the determined powers of the signal in each of the plurality of frequency ranges by a respective gain value, and re-synthesising an audio signal in dependence on the outputs of those amplifications so as to form a noise reduced signal.

45. A method as claimed in claim 39, wherein each time period spans a plurality of frames and the method comprises determining the minima of each of the power data sets for a time period as being the minimum of the powers determined over a respective frequency range for individual frames during that time period.

46. A method as claimed in claim 39, wherein the or each of the power data sets that is formed by combining the powers determined for two or more frequency ranges is formed by combining the powers determined for adjacent frequency ranges.

* * * * *